US005974825A

United States Patent [19]

Simmons et al.

[11] Patent Number: 5,974,825

[45] Date of Patent: Nov. 2, 1999

[54] BEVERAGE DISPENSER WITH ENHANCED COOLING EFFICIENCY

[75] Inventors: Darren Simmons; David N. Money, both of San Antonio, Tex.

[73] Assignee: Lancer Partnership, Ltd., San Antonio, Tex.

[21] Appl. No.: 09/136,086

[22] Filed: Aug. 18, 1998

[51] Int. Cl.[6] ..... B67D 5/62

[52] U.S. Cl. ..... 62/394; 62/396; 62/399; 62/290

[58] Field of Search ..... 62/394, 396, 399, 62/290

[56] References Cited

U.S. PATENT DOCUMENTS

| | | | |
|---|---|---|---|
| 3,255,609 | 6/1966 | Jacobs et al. | 62/394 |
| 3,422,634 | 1/1969 | Brown | 62/394 |
| 3,561,228 | 2/1971 | Scott | 62/394 |
| 3,822,565 | 7/1974 | Arzberger | 62/392 |
| 4,801,048 | 1/1989 | Credle, Jr. et al. | 222/129.1 |
| 5,427,276 | 6/1995 | Knuettel, II et al. | 62/394 |
| 5,564,602 | 10/1996 | Cleland et al. | 222/146.6 |

*Primary Examiner*—Henry Bennett
*Assistant Examiner*—Mark Shulman
*Attorney, Agent, or Firm*—Christopher L. Makay; Rafael V. Baca

[57] ABSTRACT

A beverage dispenser includes a product source, a housing that defines a cooling chamber and has dispensing valves mounted thereon, helically-shaped product lines for communicating product from the product source to the dispensing valves, a water line positioned in the bottom of the cooling chamber for communicating water to the dispensing valves, a refrigeration unit mounted over the cooling chamber that includes an evaporator coil extending into the cooling chamber, and an agitator mounted over the cooling chamber for circulating unfrozen cooling fluid along a circuitous path about the cooling chamber. The cooling chamber contains a cooling fluid, a portion of which freezes about the evaporator coil during the operation of the refrigeration unit to form a frozen cooling fluid slab. The agitator drives unfrozen cooling fluid circuitously about the exterior surface of the slab and through a channel, formed by the interior surface of the slab, to facilitate heat exchange. Furthermore, the helical configuration of the product line provides for the unobstructed circuitous flow of cooling fluid about the cooling chamber and directs the flow of cooling fluid between a series of coils as well as about an exterior portion and through a passageway, all of which define the helically-shaped product line, and, thus, providing maximum contact and maximum heat transfer between the unfrozen cooling fluid and the helically-shaped product line.

13 Claims, 4 Drawing Sheets

BEVERAGE DISPENSER WITH ENHANCED COOLING EFFICIENCY

BACKGROUND OF THE INVENTION

1. Field of the Invention

The present invention generally relates to beverage dispensers and, more particularly, but not by way of limitation, to a beverage dispenser with an improved component configuration which increases both the beverage dispensing capacity and the quantity of beverage dispensed at a cooler temperature.

2. Description of the Related Art

Self-service beverage dispensers are growing in popularity and availability. In the past, beverage dispensers were kept by restaurants in the restricted domain of the kitchen and, thus, were kept far away from the customer. Now, from gas stations to video cassette rental stores, the use of self-service beverage dispensers is expanding into many, once unimaginable, commercial markets. More people today enjoy the convenience of selecting their beverage of choice from a beverage dispenser. By placing a cup accordingly and activating its nozzle, the beverage dispenser dispenses the desired drink into the cup at a preset rate and at a desired temperature, such as the industry standard, 42° F.

In such new commercial settings, beverage dispensers must compete with other products for limited shelf space. Accordingly, there is a demand to design compact beverage dispensers that can sufficiently serve a large number of customers. Consequently, compact designs featuring beverage dispensers with smaller and, thus, slower internal refrigeration units compromises the ability to serve large numbers of customers beverages below the standard of 42° F. Ultimately, designers of compact beverage dispensers identified a need to increase the cooling efficiency of its refrigeration units to accommodate large volumes of customers.

U.S. Pat. No. 5,499,744 issued Mar. 19, 1996 to Hawkins discloses a beverage dispenser, which attempts to combine compactness with increased beverage dispensing capacity. In operation, a refrigeration unit cools a cooling fluid within a cooling chamber so that the cooling fluid freezes in a slab about the refrigeration unit's evaporator coil that is set within the cooling chamber. An agitator motor drives an impeller via a shaft to circulate unfrozen cooling fluid about the cooling chamber. Such circulation provides for the heat transfer of relatively warmer product and water lines that are also set within the cooling chamber. Particularly, the unfrozen cooling fluid receives heat from the product and water lines and delivers heat to the frozen cooling slab as it circulates about the cooling chamber. As such, the frozen cooling fluid melts to dissipate the heat from the product and water so that a resulting cold beverage is dispensed.

Proper circulation requires a steady flow of the unfrozen cooling fluid from underneath the frozen cooling fluid slab, around its sides, over its top, and back through its center. Circulation of the unfrozen cooling fluid along the above described path is essential to the heat transfer process which produces cool drinks and increases beverage dispensing capacity. Unfortunately, the product lines of the beverage dispenser disclosed in U.S. Pat. No. 5,499,744 fail to provide for the maximum transfer of heat between the product and cooling fluid which results in a diminished beverage dispensing capacity. In particular, the product line is configured so that a small amount of cooling fluid is exposed to the total outer surface of the product line as it circulated about the above described path, and, thus, diminishing heat transfer.

U.S. Pat. No. 3,892,355 issued Jul. 1, 1975 to Schroeder and U.S. Pat. No. 4,916,910 issued Apr. 17, 1990 to Schroeder both disclose compact beverage dispensers. However, the configuration of product and water lines within the cooling chamber does not allow for the maximum transfer of heat between the cooling fluid and the product and water.

Accordingly, there is a long felt need for a compact beverage dispenser which occupies very little shelf space and permits the maximum transfer of heat between the product and water lines and the unfrozen cooling fluid, thereby increasing cooling efficiency and, ultimately, drink dispensing capacity.

SUMMARY OF THE INVENTION

In accordance with the present invention, a beverage dispenser includes a product source, a housing which defines a cooling chamber, dispensing valves mounted on the housing, helically-shaped product lines coupled to the product source and positioned in the cooling chamber, a water line positioned in the bottom of the cooling chamber, an agitator, and a refrigeration unit mounted over the cooling chamber which includes an evaporator coil that extends into the cooling chamber. The helically-shaped product lines and water line communicate with the dispensing valves to deliver a product, typically a beverage syrup, and water, typically carbonated water, to each of the dispensing valves, respectively. The cooling chamber contains a cooling fluid, typically water, for removing heat from the product and water flowing through the helically-shaped product lines and water line, respectively. The agitator circulates the cooling fluid about the cooling chamber to enhance the heat exchange between the cooling fluid and product and water.

The refrigeration unit operates to cool the cooling fluid such that a slab of frozen cooling fluid forms about the evaporator coil. Moreover, the slab forms in a manner so as to include an interior portion defining a channel for facilitating an optimal flow of unfrozen cooling fluid therethrough.

The placement of the helically-shaped product lines in the front of the cooling chamber significantly increases the drink dispensing capacity of the beverage dispenser by permitting increased circulation of the unfrozen cooling fluid. More particularly, the removal of the helically-shaped product lines from the center of the evaporator coil eliminates the obstruction of flow of unfrozen cooling fluid experienced by beverage dispensers having product lines centered within the evaporator coil. The helically-shaped product lines include an exterior portion and an interior portion defining a passageway, whereby cooling fluid flows about the exterior portion and through the passageway to facilitate maximum contact and maximum heat transfer between the cooling fluid and the helically-shaped product line. Furthermore, a helically-shaped product line is defined by a series of coils where each pair of adjacent coils includes an optimal distance therebetween for allowing cooling fluid to flow between each coil to facilitate maximum contact and maximum heat transfer. Each coil, in turn, is substantially parallel to the top and bottom of the cooling chamber to provide for a uniform distribution of cooling fluid that comes into contact with the circuitous flow of unfrozen cooling fluid about the cooling chamber. Each coil can be configured with a thin wall thickness and/or a rough outer surface texture to enhance heat transfer about each coil. The material composition of the helically-shaped product line can also be configured to best facilitate for thermal absorption at cooler temperatures.

Accordingly, the completely unobstructed path for the unfrozen cooling fluid about all sides of the frozen cooling fluid slab, as well as through the channel defined by the interior portion of the frozen cooling fluid slab, combined with the unique configuration of the helically-shaped product lines increases the circulation of unfrozen cooling fluid to provide maximum surface contact between the frozen and unfrozen cooling fluid. That maximum surface area contact results in maximum heat transfer from the product and water to the unfrozen cooling fluid and, in turn, to the frozen cooling fluid slab. Consequently, the beverage dispenser exhibits an increased beverage dispensing capacity because the unfrozen cooling fluid maintains a temperature of approximately 32° F. even during peak use periods due to its increased circulation and corresponding increased cooling efficiency.

It is, therefore, an object of the present invention to provide a beverage dispenser design which enhances the circulation of unfrozen cooling fluid flowing within a cooling chamber.

It is another object of the present invention to provide a beverage dispenser with a helically-shaped product line positioned in the cooling chamber wherein helical configuration of the product line provides for the unobstructed circuitous flow of cooling fluid about the cooling chamber and directs the flow of cooling fluid between the coils as well as about the exterior portion and through the passageway, all of which define the helically-shaped product line, and, thus, providing maximum contact and maximum heat transfer between the cooling fluid and the helically-shaped product line.

Still other objects, features, and advantages of the present invention will become evident to those skilled in the art in light of the following.

DETAILED DESCRIPTION OF THE PREFERRED EMBODIMENT

Figure 1:
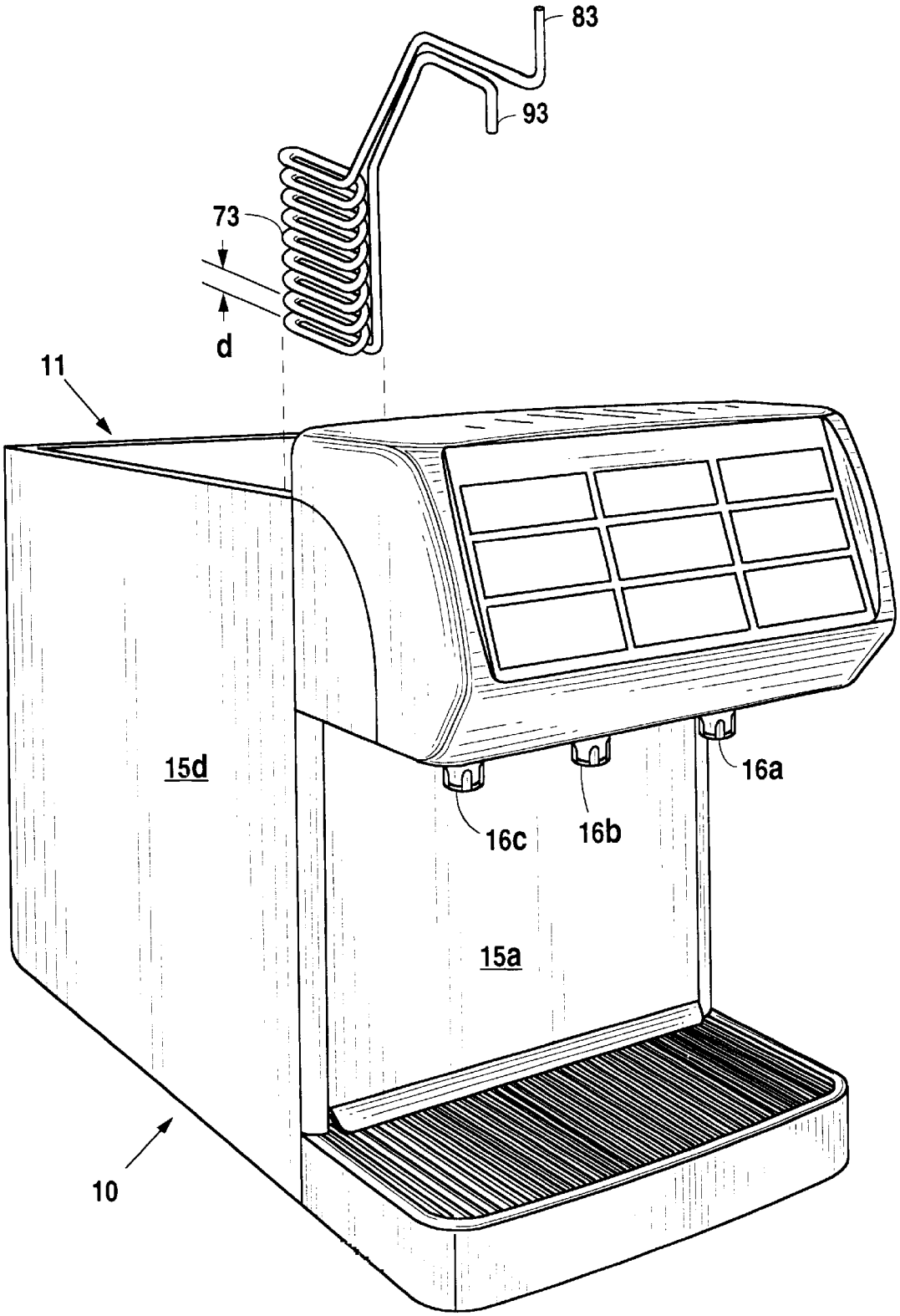
FIG. 1 is a perspective view illustrating a beverage dispenser featuring a helical product line configuration.
Figure 2:
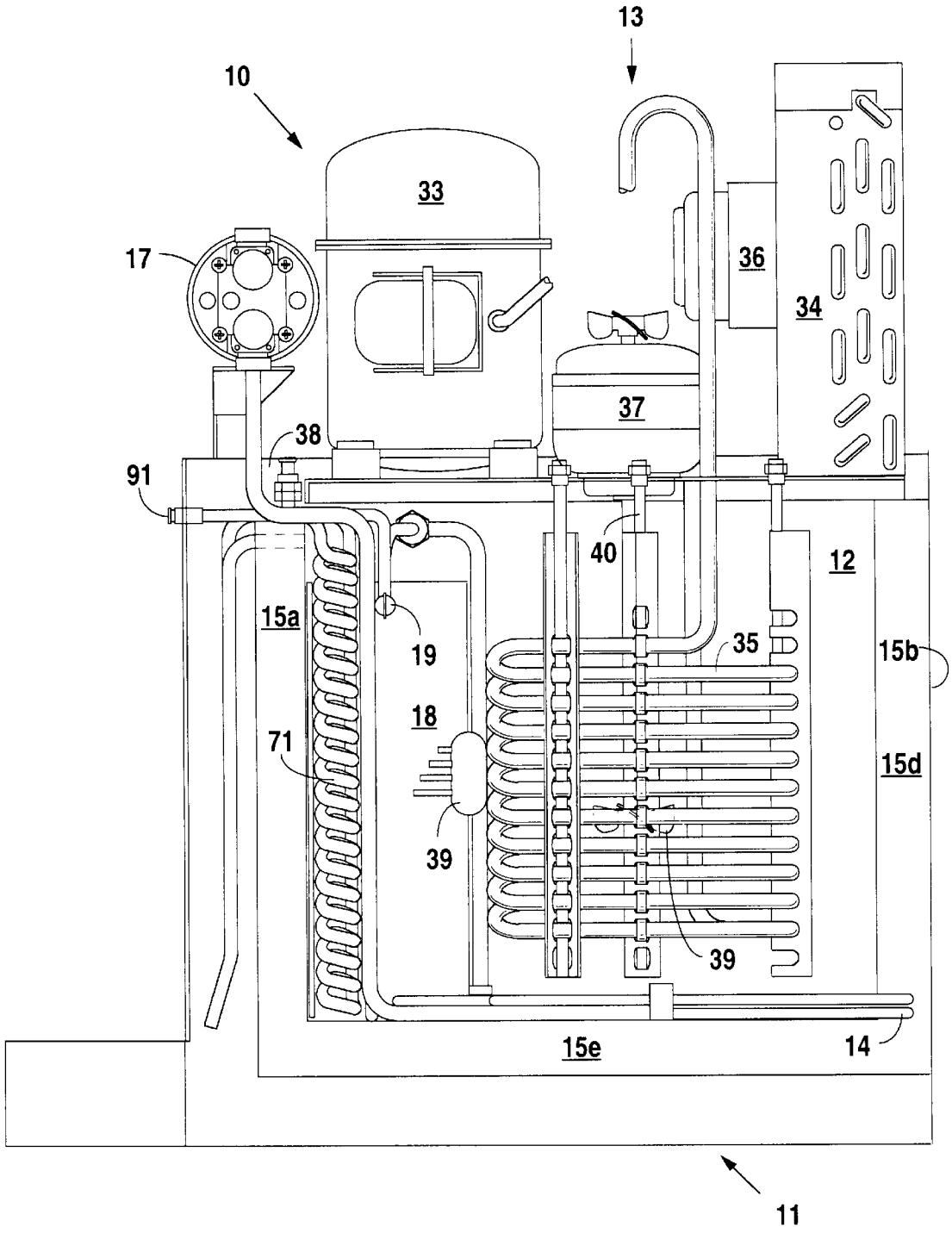
FIG. 2 is a side elevation view in cross-section illustrating the beverage dispenser.
Figure 3:
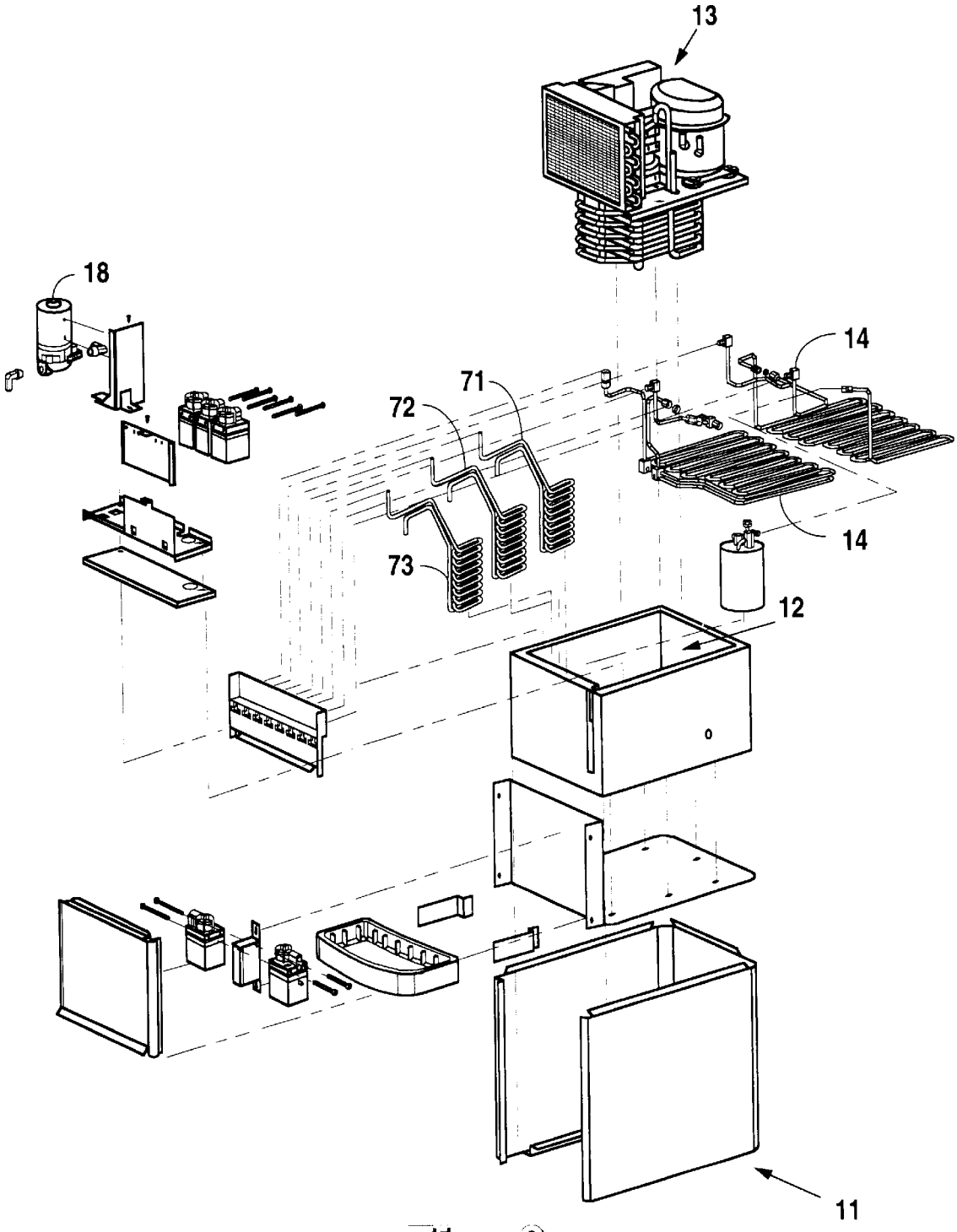
FIG. 3 is an exploded view illustrating the beverage dispenser.

As required, detailed embodiments of the present invention are disclosed herein; however, it is to be understood that the disclosed embodiments are merely exemplary of the invention which may be embodied in various forms. The figures are not necessarily to scale, and some features may be exaggerated to show details of particular components or steps.

As illustrated in FIGS. 1–4, beverage dispenser 10 includes housing 11, refrigeration unit 13, water line 14, product lines 71–73, and dispensing valves 16A–C. Housing 11 comprises a front wall 15A, rear wall 15B, side walls 15C and D, and bottom 15E which define the cooling chamber 12. Cooling chamber 12 contains a cooling fluid, which is typically water. Dispensing valves 16A–C each connect to front wall 15A using suitable connecting means.

Water line 14 includes a serpentine configuration to permit its placement on the bottom of cooling chamber 12. Water line 14 mounts to bottom 15E of housing 11 using any suitable mounting means. An inlet to water line 14 connects to water pump 17 which, in turn, connects to any suitable water source such as tap water. An outlet from water line 14 connects to a T-connector (not shown).

The T-connector delivers the water received from the water line 14 to carbonator 18 from one of its outlets. Carbonator 18 connects to and receives carbon dioxide from a carbon dioxide source to carbonate the water delivered from water line 14 via one of the outlets from the T-connector. Carbonator 18 mounts within the front of the cooling chamber 12 using any suitable mounting means.

The outlet from carbonator 18 connects to the inlet into manifold 19. Manifold 19 connects at one end to carbonator 18 and at an opposite end to side wall 15C of housing 11 using any suitable connecting means. Manifold 19 receives the carbonated water from carbonator 18 and delivers it to dispensing valves 16A–C via outlets 20–22, respectively.

Product lines 71–73 reside in front of cooling chamber 12 and mount within the cooling chamber 12 using any suitable mounting means. Additionally, manifold 19 mounts to carbonator 18 and side wall 15C of housing 11 such that it resides directly behind and abuts the backs of each of product lines 71–73. Manifold 19 abuts product lines 71–73 to prevent their movement away from front wall 15A.

Each of product lines 71–73 includes an inlet 81–83, respectively, which communicates with a product source (not shown). Product lines 71–73 include outlets 91–93 which connect to dispensing valves 16A–C, respectively, to supply product to dispensing valves 16A–C. Furthermore, product lines 71–73 each uniquely include a helical configuration to better facilitate heat transfer by providing greater surface area along each product line to thermodynamically interact with the circulating cooling fluid. As shown in FIG. 1, to ensure that unfrozen cooling fluid interacts with a maximum effect, an optimal distance, d, between adjacent coils of the helical product line is provided. Although three product lines and dispensing valves are disclosed, one of ordinary skill in the art will recognize that additional product and dispensing valves or fewer product lines and dispensing valves may be implemented in any combination. It is also apparent to one of ordinary skill in that the optimal distance, d, may vary between coils along an individual helical product line.

Refrigeration unit 13 comprises a standard beverage dispenser refrigeration system which includes a compressor 33, a condenser coil 34, an evaporator coil 35, and a fan 36. Compressor 33 and condenser coil 34 mount on top of platform 38 while evaporator coil 35 mounts underneath. Fan 36 mounts to condenser coil 34 to blow air across condenser coil 34 to facilitate heat transfer. Platform 38 mounts on top of housing 11 so that evaporator coil 35 will reside above water line 14 within the center portion of cooling chamber 12.

Refrigeration unit 13 operates similarly to any standard beverage dispenser refrigeration system to cool the cooling fluid residing within cooling chamber 12 such that the cooling fluid freezes in a slab about evaporator coil 35. Refrigeration unit 13 cools and ultimately freezes the cooling fluid to facilitate heat transfer between the cooling fluid and the product and water so that a cool beverage may be dispensed from beverage dispenser 10. However, because complete freezing of the cooling fluid results in an inefficient heat exchange, a cooling fluid bank control system (not shown) regulates the compressor 33 to prevent the complete freezing of the cooling fluid such that the compressor 33 never remains activated for a time period sufficient to allow the frozen cooling fluid slab to grow onto product lines 71–73.

Agitator motor 37 mounts onto platform 38 to drive impeller 39 via shaft 40. Agitator motor 37 drives impeller 39 to circulate the unfrozen cooling fluid around the frozen cooling fluid slab as well as about water line 14 and product lines 71–73. Impeller 39 circulates the unfrozen cooling fluid to enhance the transfer of heat which naturally occurs between the lower temperature cooling fluid and the higher temperature product and water. Heat transfer results from the product and water flowing through product lines 71–73 and water line 14, respectively, giving up heat to the unfrozen cooling fluid. The unfrozen cooling fluid, in turn, transfers the heat to the frozen cooling fluid slab which receives that heat and melts in response and, thus, completes the thermodynamic cycle by providing "liquid" or unfrozen cooling fluid into cooling chamber 12. The heat originally transferred from the product and water into the cooling fluid is continuously dissipated through the melting of the frozen cooling fluid slab. Accordingly, that dissipation of heat and corresponding melting of frozen cooling fluid slab maintain the frozen cooling fluid at the desired temperature of 32° F., which is ideally below the industry standard.

The effectiveness of the above-described transfer of heat relates directly to the amount of surface area contact between the unfrozen cooling fluid and the frozen cooling fluid slab. That is, if the unfrozen cooling fluid contacts the frozen cooling fluid slab along a maximum amount of its surface area, the transfer of heat significantly increases. Beverage dispenser 10 maintains maximum contact of unfrozen cooling fluid along the surface of the frozen cooling fluid slab due to the positioning of the water line 14 in the bottom portion of the cooling chamber 12 and the placement of product lines 71–73 in the front portion of cooling chamber 12. Maximum contact is further achieved due to the serpentine configuration of water line 14 and the unique helical configuration of product lines 71–73.

Specifically, the removal of product lines and water lines from the center of the evaporator coil eliminates the obstruction to the flow of unfrozen cooling fluid experienced by beverage dispensers having one or both of the product and water lines centered within the evaporator coil. Furthermore, by increasing the size of evaporator coil 35, a larger frozen cooling slab forms. Particularly, the placement of the product lines 71–73 in the front portion of cooling chamber 12 permits the size of evaporator coil 35 to be increased without a corresponding increase in the height of housing 11. A larger frozen cooling fluid slab provides a greater surface area for the transfer of heat with the unfrozen cooling fluid. That increase in cooling efficiency through heat transfer from the unfrozen cooling fluid to the frozen cooling fluid slab maintains the unfrozen cooling fluid at 32° F., even during peak use periods of beverage dispenser 10. Consequently, the ability to increase the heat extracted from the product and water significantly increases the overall beverage dispensing capacity of beverage dispenser 10.

Figure 4:
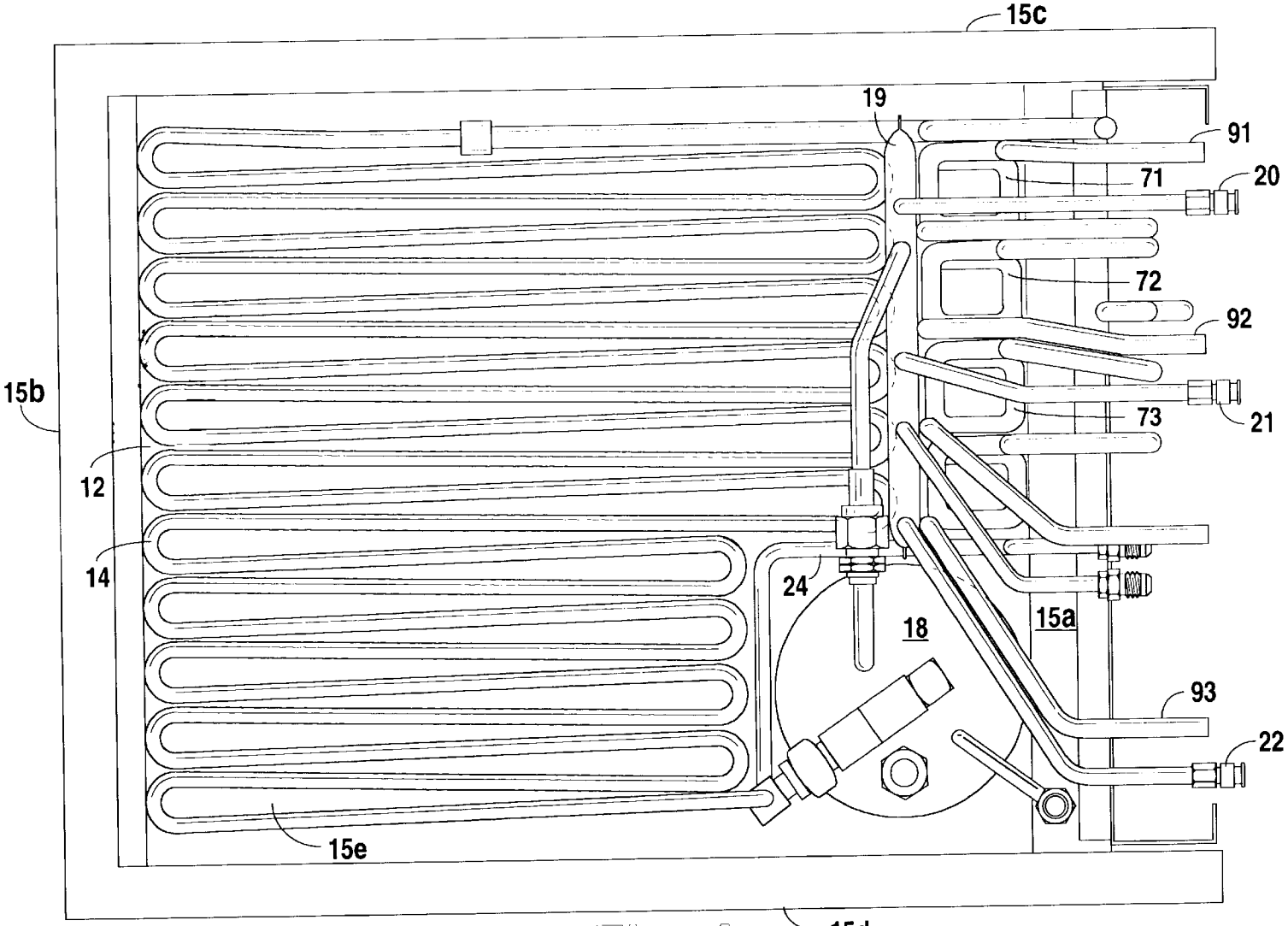
FIG. 4 is a top elevation view illustrating the positioning of the product and water lines within the cooling chamber of the present invention.

The serpentine configuration of water line 14 increases the effectiveness of the circulation of unfrozen cooling fluid by impeller 39. As shown in FIG. 4, the serpentine configuration of water line 14 produces channels which are defined by each turn of the tubing which comprises water line 14. The channels of water line 14 are provided to direct the flow of unfrozen cooling fluid toward front wall 15A and back wall 15B of housing 11.

The overall helical configuration of product lines 71–73 also increases the effectiveness of the circulation of unfrozen cooling fluid by impeller 39. Along with the placement in the front portion of cooling chamber 12, the helical configuration of product lines 71–73 is designed to capitalize on the upwardly driven flow of unfrozen cooling fluid by impeller 39 from the bottom 15E, along the front wall 15A, and toward the top of the cooling chamber 12. Specifically, the spatial planes defined by the maximum planar intersection with each of the coils of a helical product line are nearly parallel to the top and bottom of the cooling chamber 12 and, thus, providing a uniform distribution of unfrozen cooling fluid that comes into contact with the entire outer surface of the product line. If the spatial planes of the coils were nearly perpendicular to the top and bottom of the cooling chamber 12, as in U.S. Pat. No. 5,499,744 to Hawkins, the portions of each coil nearest to the bottom 15E would most likely come into contact with the upward flow of unfrozen cooling fluid rather than those portions of each coil nearest to the top of the cooling chamber, which leads to an uneven distribution of contact about the outer surface of the product line and an overall inefficient transfer of heat across that surface. Additionally, one of ordinary skill in the art will recognize that the spatial planes created by each coil in a particular product line may vary in angularity from one another.

Moreover, the optimal distance, d, between adjacent coils of a helical product line allows for better flow of unfrozen cooling fluid and, ultimately, allows for a better transfer of heat about each coil. If adjacent coils were to become too close together, the flow of cooling fluid between coils would be hindered and would lead to inefficiency.

The outer surface texture of the coils can also be configured to allow for different rates of heat transfer as well. For example, coils with a rough texture slows the flow rate of cooling fluid by allowing the fluid to "cling" to the coils for a longer time so as to further cool the product within the line. In much the same way as the outer surface texture can be configured, those skilled in the art will recognize that a thin wall thickness of the coils as well as the material composition, for facilitating better thermal absorption at cooler temperatures, of the coils can be configured to accommodate different rates of heat transfer.

In operation, agitator motor 37 drives impeller 39 to force unfrozen cooling fluid from a channel defined by evaporator coil 35 toward water line 14. As the unfrozen cooling fluid enters the channels of water line 14, these channels direct the unfrozen cooling fluid toward the front wall 15A and back wall 15B of housing 11. More particularly, the channels direct a first stream of unfrozen cooling fluid toward the front wall 15A and a second stream of unfrozen cooling fluid toward the rear wall 15B.

As the first stream of unfrozen cooling fluid flows into the front portion of cooling chamber 12, it contacts product lines 71–73 to remove heat from the product flowing therein. Furthermore, the unfrozen cooling fluid contacts the frozen cooling fluid slab to transfer heat therebetween. Likewise, as the second stream of unfrozen cooling fluid flows into the rear portion of cooling chamber 12, it contacts the frozen cooling fluid slab to produce heat transfer therebetween.

The first and second streams of unfrozen cooling fluid circulate from the front and rear portion of the cooling chamber 12, respectively, into the top portion of cooling chamber 12. As the first and second streams of unfrozen cooling fluid enter the top portion of cooling chamber 12, they contact the top of the frozen cooling fluid slab to produce heat transfer therebetween. Furthermore, the first and second streams of unfrozen cooling fluid flow into the channel defined by evaporator coil 35 where such streams recombine to contact the frozen cooling fluid slab for a further heat transfer. The recombined cooling fluid stream entering the channel defined by evaporator coil 35 are again forced from the channel toward water line 14 by impeller 39 so the above-described circulation repeats.

Additionally, impeller 39 propels unfrozen cooling fluid from the channel defined by evaporator coil 35 toward side walls 15C and D. The unfrozen cooling fluid divides into third and fourth streams of unfrozen cooling fluid which travel a circuitous path around the sides of the frozen cooling fluid slab, over the top of the frozen cooling fluid slab, and back to the channel defined by evaporator coil 35. That flow of the third and fourth streams of unfrozen cooling fluid produces additional heat transfer from the product and water to the unfrozen and frozen cooling fluid.

Accordingly, the completely unobstructed path for unfrozen cooling fluid about all sides of the frozen cooling fluid slab as well as through the center of the frozen cooling fluid slab provides maximum surface area contact between frozen and unfrozen cooling fluid. That maximum surface area contact results in maximum heat transfer from the product and water to the unfrozen cooling fluid and then to the frozen cooling fluid slab. Consequently, beverage dispenser 10 exhibits an increased beverage dispensing capacity because the unfrozen cooling fluid maintains a temperature, below the industry standard, of approximately 32° F. even during peak use periods due to its increased heat transferred and corresponding increased circulation.

Without the constant circulation of unfrozen cooling fluid, the same unfrozen cooling fluid would remain between rear wall 15B and side walls 15C and D and the frozen cooling fluid slab. Eventually, that unagitated unfrozen cooling fluid would freeze because it would not receive sufficient heat from the product and water to prevent its freezing. Accordingly, the increased circulation of unfrozen cooling fluid produced by the configuration of beverage dispenser 10 not only produces a larger beverage dispensing capacity in beverage dispenser 10, but it also prevents a freeze-up of cooling fluid which would severely limit that beverage dispensing capacity.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims that follow.

We claim:

1. A beverage dispenser, comprising:

a product source;

a housing defining a cooling chamber having a cooling fluid contained therein; dispensing valves mounted on the housing;

a helically-shaped product line coupled to the product source and positioned in the cooling chamber for communicating product to the dispensing valves; and a refrigeration unit mounted over the cooling chamber, the refrigeration unit having an evaporator coil extending into the cooling chamber for freezing cooling fluid thereabout.

2. The beverage dispenser according to claim 1 wherein the frozen cooling fluid about the evaporator coil forms a slab of cooling fluid.

3. The beverage dispenser according to claim 2 wherein the cooling fluid slab includes an interior portion defining a channel, formed by the interior surface of the slab, thereby facilitating an optimal flow of unfrozen cooling fluid therethrough.

4. The beverage dispenser according to claim 1 further comprising an agitator for circulating unfrozen cooling fluid along a circuitous path about the interior and exterior of the cooling fluid slab.

5. The beverage dispenser according to claim 1 further comprising a water line positioned in the cooling chamber for communicating water to the dispensing valves.

6. The beverage dispenser according to claim 1 wherein the helically-shaped product line is defined by a series of coils.

7. The beverage dispenser according to claim 6 wherein each coil is substantially parallel to the top and bottom of the cooling chamber.

8. The beverage dispenser according to claim 6 wherein each pair of adjacent coils that define the helically-shaped product line includes an optimal distance therebetween whereby cooling fluid flows between each coil to facilitate maximum contact and maximum heat transfer between the cooling fluid and the helically-shaped product line.

9. The beverage dispenser according to claim 6 wherein the helically-shaped product line has a rough outer surface texture thereby maximizing the heat transfer about each coil.

10. The beverage dispenser according to claim 6 wherein the helically-shaped product line has a thin wall thickness thereby maximizing the heat transfer about each coil.

11. The beverage dispenser according to claim 1 wherein the helically-shaped product line includes an exterior portion and an interior portion defining a passageway whereby cooling fluid flows about the exterior portion and through the passageway to facilitate maximum contact and maximum heat transfer between the cooling fluid and the helically-shaped product line.

12. The beverage dispenser according to claim 1 wherein the helically-shaped product line is positioned in front of the cooling chamber for communicating the product to the dispensing valves.

13. The beverage dispenser according to claim 1 wherein the material composition of the helically-shaped product line is provided to best facilitate for thermal absorption at cooler temperatures.

* * * * *